United States Patent [19]

Maillard

[11] Patent Number: 4,473,907

[45] Date of Patent: Oct. 2, 1984

[54] COMBINED INSULATED ENCLOSURE AND BIB FOR SUPPORT OF A NURSING BOTTLE

[76] Inventor: Susan Maillard, 47 Middle Line Ave., Medford, N.Y. 11763

[21] Appl. No.: 521,684

[22] Filed: Aug. 10, 1983

[51] Int. Cl.[3] ..... A41B 13/00; A47D 15/00

[52] U.S. Cl. ..... 2/49 R; 248/102

[58] Field of Search ..... 2/49 R; 248/102, 105; 224/148

[56] References Cited

U.S. PATENT DOCUMENTS

| | | | |
|---|---|---|---|
| 2,474,416 | 6/1949 | DuBois | 248/105 |
| 2,955,382 | 10/1960 | Boles | 248/102 |
| 3,163,194 | 12/1964 | Berry et al. | 248/102 |

*Primary Examiner*—Doris L. Troutman

*Attorney, Agent, or Firm*—Kevin Redmond

[57] ABSTRACT

A combined enclosure and support for an infant's feeding bottle in which the bottle is inserted with the nipple projecting upwards in a position to facilitate the infant's feeding itself. The invention is formed of two principal portions, a bib which covers the chest area and a lower appended enclosure for the bottle. Straps attached to the bib are provided for securing the bib about the infant's neck. The enclosure contains an outward facing vertical slot. Across this slot are horizontal elastic straps that are separated from one another in the vertical direction. The spacing between the elastic straps permits a visual determination of the amount of fluid remaining in the bottle without removal, while the elasticity of the straps accommodates a variety of bottle sizes. The bib and enclosure, in one embodiment, are formed of quilted material to provide insulation designed to maintain the bottle at its initial temperature. The bib may also be secured about the nipple to preserve its sanitary condition prior to use by the infant. Another embodiment utilizes paper of various forms to provide all the components, thereby permitting the bib to be disposed of after each use.

11 Claims, 5 Drawing Figures

COMBINED INSULATED ENCLOSURE AND BIB FOR SUPPORT OF A NURSING BOTTLE

BACKGROUND

This invention relates to infant bibs and, more particularly, to such bibs designed to support nursing bottles. A number of bibs designed to support nursing bottles are available as illustrated by U.S. Pat. No. 2,631,288 which shows a bib and bottle holding device. The bottle in this invention is supported at a point in the widest section of the bib. This design makes it possible for the infant to feed itself while laying down with the bottle positioned to rest on the infant's chest. However, if the infant is placed in a sitting position, it would not be possible for the infant to grasp and lift the bottle in order to drink because the bib's width forms an encumbrance that prevents grasping the bottle.

U.S. Pat. No. 232,058 illustrates a bottle holding infant's jacket. This device permits the infant to grasp the bottle, but the bottle is completely enclosed preventing a visual determination of liquid remaining in the bottle. In addition, this jacket requires considerable effort in threading the infant's arms through the sleeves and securing the jacket to the infant prior to feeding. U.S. Pat. No. 3,543,976 illustrates a flexible support for a nursing bottle which comprises a strap that fits around the infant's neck and is attached at another point to the neck of the bottle. It can be used to feed the infant in any position and the quantity of liquid is clearly visible at all times. However, there is no provision for insulating the bottle or protecting the nipple for sanitary purposes.

U.S. Pat. No. 784,914 illustrates a nursing bottle holder comprising a bag to hold the bottle and a cord attached to the bag for securing the device about the infant's neck. This design permits an infant to feed in any position, however, there is no provision for visually determining the amount of liquid remaining in the bottle. In addition, the bag is designed to fit tightly about a bottle that has a narrow neck, thereby limiting the variety of bottles that may be used with this invention.

U.S. Pat. No. 2,389,390 illustrates a combined protective enclosure and support for infant's feeding bottles. This design is specifically intended for use with the infant in a reclined position. The bottle holder is attached to the widest section of the bib, making it difficult for the infant to feed itself in any position other than the reclined position. A tightly fitting holder about the bottle prevents a variety of bottles being used.

SUMMARY

It is an object of the present invention to provide a combined insulated enclosure and bib for support of a nursing bottle which features a means for visually determining the amount of fluid remaining in the bottle without removing the bottle from its holder.

It is an object of the present invention to provide a combined insulating enclosure and bib for support of a nursing bottle that can accept and securely hold a variety of bottle sizes.

It is an object of the present invention to provide a means for insulating and preserving the sanitary conditions of the bottle and nipple.

It is an object of the present invention to provide a combined insulating enclosure and bib support for a nursing bottle that can be quickly and easily attached to the infant.

It is an object of the present invention to provide a combined insulating enclosure and bib support for a nursing bottle which will enable the infant to feed itself regardless of its position.

The present invention is a combined enclosure and support for an infant's feeding bottle in which the bottle may be inserted with the nipple projecting upward in a position to permit the infant to facilitate feeding itself. The bib has a main portion cut to cover the infant's chest area and straps attached to the marginal area about its upper end for securing the bib about the infant's neck. A bottle support section, attached to the lower central portion of the bib, encloses the sides and bottom of the bottle, except for a vertical slot facing outward which is only partially closed by elastic straps. The spaces between the elastic straps permit viewing the amount of fluid remaining in the bottle and the straps themselves permit expansion or contraction of the support section to accommodate a variety of bottle sizes.

DETAILED DESCRIPTION OF THE INVENTION

Figure 1:
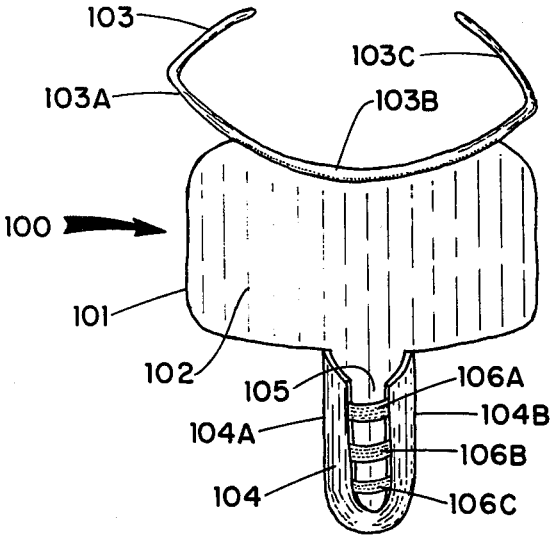
FIG. 1 is a front elevation view of the present invention showing the bib section, appended bottle enclosure and securing straps.

Referring to FIG. 1, the invention 100 comprises a bib 101, a bottle enclosure 104 appended to the lower portion of the bib, and a securing strap 103, attached to the upper portion of the bib. The bib may be formed of quilted material as indicated by stitching line 102 used to hold the internal packing in place. The bib may alternatively be made of moisture and heat resistant material to aid in cleaning and maintaining the initial temperature of the bottle. The securing straps 103 may be divided into a left-hand portion 103A, a central portion 103B and a right-hand portion 103C. The central portion 103B is secured to the upper margin of the bib 101. The bottle enclosure or bottle support section 104 is formed of a left-hand portion 104A and a right-hand portion 104B. An outward facing slot 105 separates the left and right-hand portions of the bottle enclosure. Across the slot 105 are a series of horizontal elastic straps 106A through 106C.

Figure 2:
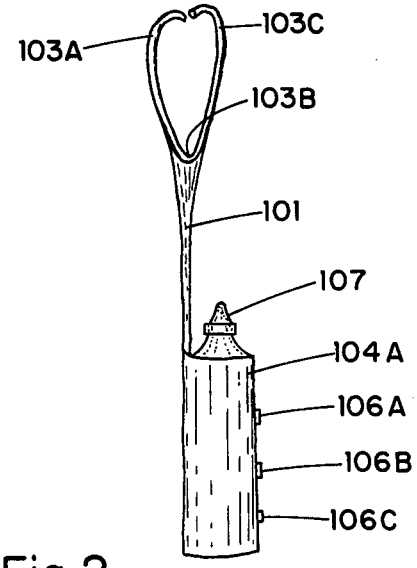
FIG. 2 is a side elevation showing the position of a bottle placed in the bottle enclosure portion.
Figure 3:
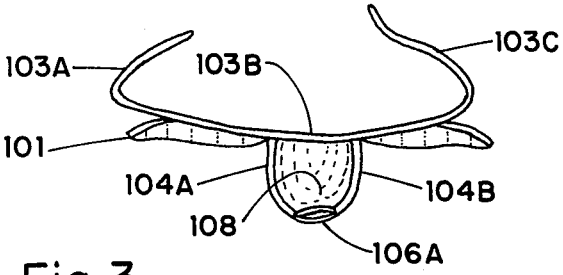
FIG. 3 is a plan view of the invention shown in FIG. 1.

FIG. 2 shows a side elevation view of the invention shown in FIG. 1 with a bottle 107 placed in the bottle enclosure 104. FIG. 3 shows a plan view of the device in FIG. 1 and more clearly illustrates the position of the elastic strap 106A and the opening for the bottle 108.

In the use of the present invention, the securing straps 103A and 103C are tied about the infant's neck. The bib 101 lays across the chest area of the infant while the bottle in its enclosure 104 is held in a position immediately below the bib. Since the lower end of the bib and the bottle enclosure are not secured to the infant, the infant may grasp the bottle holder and bottle and lift it to drink regardless of whether the infant is in a sitting or prone position. The elastic straps securely hold the bottle in position in the enclosure and are flexible enough to accept a variety of bottle sizes. The straps 106A through 106C are spaced across the slot 105 to permit a visual determination of the amount of fluid remaining in the bottle without the need to remove the bottle for this purpose.

Figure 4:
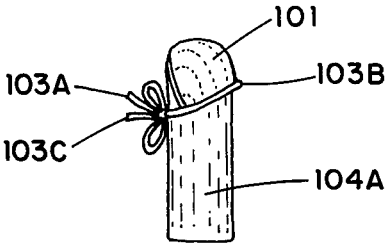
FIG. 4 is a view of the invention illustrating the use of the bib in providing an enclosure about the nipple.

FIG. 4 is a side elevation of the invention and bottle shown in FIG. 2 with the bib portion 101 folded down over the nipple and secured by means of the straps 103. The ability of the bib and straps to be secured about the nipple serves three purposes. The first is to maintain the nipple in a sanitary condition during transport, the second is to more completely enclose the bottle to maintain its initial temperature, while the third is to fold the bib in a position to make a neat package for transport.

Figure 5:
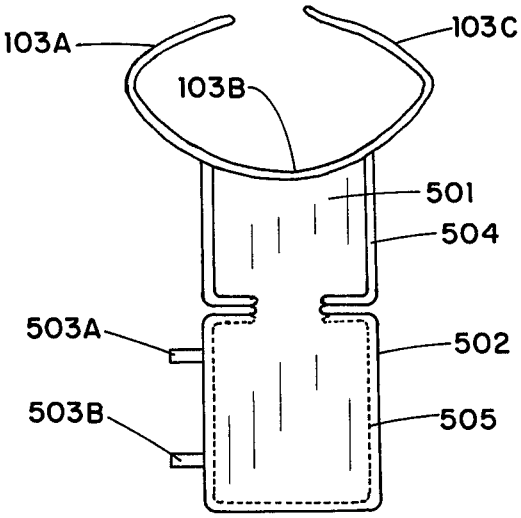
FIG. 5 is a front elevation view an embodiment of the present invention that is designed to be disposable.

FIG. 5 shows a disposable embodiment of the present invention comprising a bib 501, a bottle enclosure or bottle support section 502 appended to the lower portion of the bib, and securing strap 103 attached to the upper portion of the bib. The bib and bottle enclosure portions are formed of outer sheets of plastic or plastic impregnated paper, similar to the material used for disposable paper diapers, while the inside is filled with an absorbent paper filler also similar to that used for disposable diapers.

The outer sheets may be water impervious or porous depending on the application. The impervious sheets are employed where it is desired to protect the under clothing and possibly reuse the bib for several feedings before disposal. The porous outer sheets are employed where it is desired to absorb spills which may run off the bib on to clothing, bed sheets and the like. This latter version is particularly applicable for use by the handicapped or the elderly. When it is desired to accept liquid for absorption from only one side, only one of the outer sheets need be made porous.

The filler material may be held in place by an edge ribbon, such as ribbon 504, stitched about the edge of the bib, or the filler material may be held in position without a ribbon by stitching alone, the stitching being placed about the edge of the entire bib and bottle holder, as illustrated by stitch line 505.

The bottle enclosure is folded about the bottle and secured in place by means of adhesive straps 503A and 503B. The position of the straps as shown should be considered as illustrative. Additional straps may be added for use across the sides and bottom of the bottle enclosure without deviating from the spirit of the present design. The adhesive straps may be used to hold the bottle in place in a number of ways. For example, the straps may be used to simply secure the bottle enclosure portion tightly about the bottle, or a portion of the strap may also be used to adhere to the bottle to further aid holding the bottle in place. This latter use of the straps becomes particularly important when cups or open bottles are used to feed the handicapped or elderly. In such applications, longer straps, which may be made of adhesive tape, may be employed to provide for this method of securing the bottle or other liquid holding device and provide a means of accommodating a variety of different sized liquid holding devices.

Having described my invention, I claim:

1. Apparatus combining an enclosure and support for an infant's feeding bottle in which the bottle may be inserted with its nipple projecting upward therefrom in a position to permit the infant to facilitate feeding itself, the infant being considered as being erect and the bottle positioned vertically for reference purposes, said apparatus comprising:

(a) a bib having an upper and lower end and being formed of flexible material cut to cover the chest area of the infant, (b) means for securing the bib from its upper end about the neck of the infant, (c) a bottle support section having an upper and lower end and attached at its upper end to the lower, central portion of the bib, said bottle support section enclosing the sides and lower end of the bottle, but containing an open slot extending vertically the length of the support section on the outward side away from the bib, and (d) a plurality of separated elastic straps positioned horizontally one over the other with each spanning said open slot, the straps serving to draw the sides of the support section tightly around the bottle, thereby securing the bottle in place and said open slot between the elastic straps providing a means for visually determining the amount of fluid remaining in the bottle without removal of the bottle.

2. Apparatus as claimed in claim 1, wherein said means for securing the bib about the infant's neck is formed of two flexible securing straps, each attached to the upper margin of said bib, said bib being of sufficient vertical length and said flexible securing straps being of sufficient length to permit the bib to be folded over the bottle nipple and secured in this position by means of the two flexible securing straps to provide a means for insulating the bottle and maintain its initial temperature while enclosing the nipple to insure its remaining in a sanitary condition.

3. Apparatus as claimed in claim 1, wherein said bib and said bottle support section are formed of quilted material to aid in maintaining the bottle at its initial temperature.

4. Apparatus as claimed in claim 1, wherein said bib and said bottle support section are formed of moisture and heat resistant material to aid in cleaning and maintaining the initial temperature of the bottle.

5. Apparatus as claimed in claim 2, wherein said bib and said bottle support section are formed of moisture and heat resistant material to aid in cleaning and maintaining the initial temperature of the bottle.

6. Apparatus combining an enclosure and support for an infant's feeding bottle in which the bottle may be inserted with its nipple projecting upward therefrom in a position to permit the infant to facilitate feeding itself, the infant being considered as being erect and the bottle positioned vertically for reference purposes, said apparatus comprising:

(a) a bib having an upper and lower end and being formed of flexible material cut to cover the chest area of the infant, (b) means for securing the bib from its upper end about the neck of the infant, (c) a bottle support section having an upper and lower end and two side edges attached at its upper end to the lower, central portion of the bib, said bottle support section being sufficiently large to be capable of enclosing the sides of the bottle, and (d) a plurality of separated adhesive coated straps positioned horizontally one over the other with each being sufficiently large to be capable of spanning across the side edges of the support section to enclose a bottle, the straps serving to draw the sides of the support section tightly around the bottle, thereby securing the bottle in place.

7. Apparatus as claimed in claim 6, wherein the side edges of the support section do not meet when enclosing the bottle, leaving an open slot between the edges of the support section and between the adhesive coated straps, said open slot between the straps providing a means for visually determining the amount of fluid remaining in the bottle without removal of the bottle and said slot providing a means by which the adhesive straps may adhere directly to the bottle as well as to the edges of the support section to provide greater support for the bottle.

8. Apparatus as claimed in claim 6, wherein said bib and said bottle support section are formed of insulating material to aid in maintaining the bottle at its initial temperature.

9. Apparatus as claimed in claim 8 wherein the insulating material is of paper.

10. Apparatus as claimed in claim 6, wherein said bib and said bottle support section are formed of disposable moisture resistant paper based material to aid in cleaning and to permit disposal after several uses.

11. Apparatus as claimed in claim 10, wherein said bib and said bottle support section are formed of outer sheets of moisture resistant paper that is porous and internal absorbent paper to provide for absorbing liquid through the pores into the absorbent material to protect clothing.

* * * * *